US006017068A

United States Patent [19]

Hughes

[11] Patent Number: 6,017,068

[45] Date of Patent: Jan. 25, 2000

[54] GATE LATCH

[76] Inventor: Albert Ray Hughes, 7660 Green Meadow, Flower Mound, Tex. 75028

[21] Appl. No.: 09/014,672

[22] Filed: Jan. 28, 1998

[51] Int. Cl.[7] ..... E05C 19/00

[52] U.S. Cl. ..... 292/299; 292/283

[58] Field of Search ..... 292/204, 4, 5, 292/6, 9, 246, 248, 283, 284, 299, DIG. 13

[56] References Cited

U.S. PATENT DOCUMENTS 1,008,220 11/1911 Tullis .
1,090,969 3/1914 Browning .
1,178,980 4/1916 Shulenberger .
1,205,497 11/1916 Whitehurst .
2,545,038 3/1951 Kingdon .

*Primary Examiner*—Flemming Saether
*Assistant Examiner*—Gary Estremsky
*Attorney, Agent, or Firm*—Morgan L. Crow, P.E.

[57] ABSTRACT

A gate latch having a ring suspended in a frame cooperating with a bar mounted on a gate or the like, wherein the gate is automatically latched upon closure by preventing the ring from moving upon engagement of the latch bar, is easily unlatched by raising the ring manually, and wherein the latch can be secured in the locked or unlocked position.

9 Claims, 2 Drawing Sheets

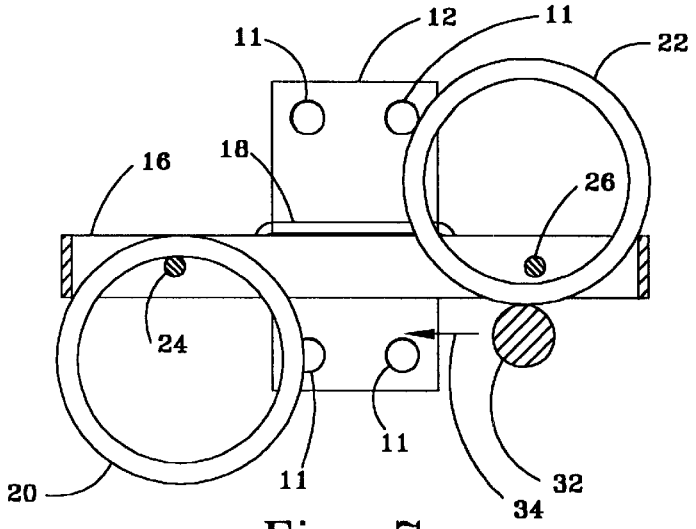
Fig. 7
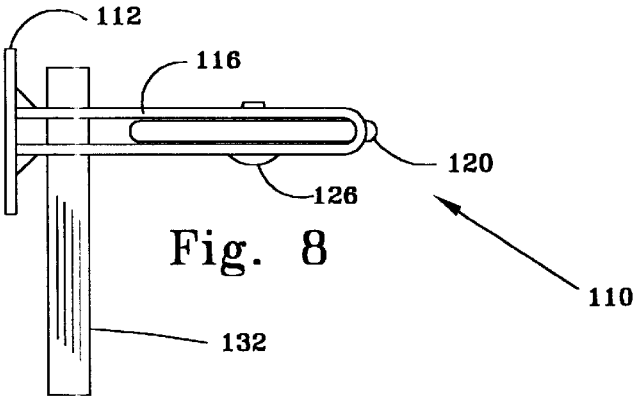
Fig. 8
Fig. 10
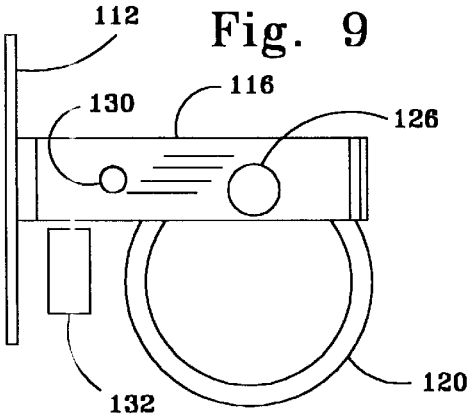
Fig. 9
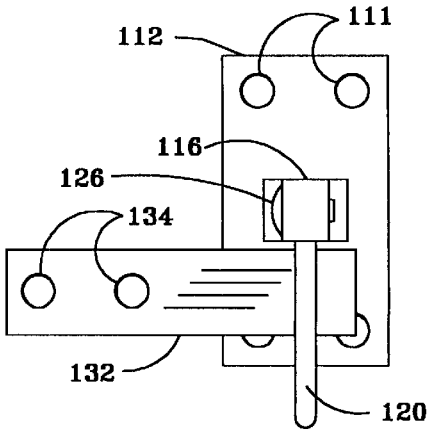

GATE LATCH

BACKGROUND OF THE INVENTION

1. The Field of the Invention

This invention relates generally to gate latches, and particularly to gate latches of the one ring and two ring type, especially for fences.

2. The Related Prior Art

In U.S. Pat. No. 1,821,847 in 1931, to Polaire, there is disclosed a gate latch with two rings suitable for use with a gate.

In U.S. Pat. No. 2,609,223 in 1951 to Adams, there is disclosed a gate latch with two rings with a handle for operating the rings.

In U.S. Pat. No. 2,545,038 in 1951, to Kingdon, there is disclosed a gate latch with one ring and a stop handle capable of receiving a padlock.

It is an object of this invention to provide a gate latch that is simple in operation.

It is an object of this invention to provide a gate latch that is rugged and inexpensive to manufacture.

It is an object of this invention to provide a gate latch that allow a gate to open inwardly and outwardly.

It is an object of this invention to provide a gate latch that can be locked with a padlock.

SUMMARY OF THE INVENTION

A gate latch for use in securing a gate or the like in a closed position, including a frame adapted to be mounted on a gate post, an elongate ring mounted on the frame and having two generally parallel sides, the sides connected at the ends of the parallel sides, a pair of pin means such as rivets extending through the parallel sides, a pair of rings positioned between the parallel sides, each ring near one of the ends, and encircling the pin means to allow each ring to rotate away from the end and to prevent the ring from rotating toward the end, a latch bar mountable on a gate to engage the rings to allow the latch bar to move from an unlatched position away from the rings to engage one of the rings to rotate the ring about one of the pins to allow the latch bar to pass under the ring to engage other of the rings, allowing the one of the rings to drop into latching position, and a lock plate moveable on the frame from a first position extending above the rings to prevent upward movement of the rings to a second position clear of the rings to allow upward movement of the rings to allow the latch to pass under either of the rings.

BRIEF DESCRIPTION OF THE DRAWINGS

FIG. 7 is a cross section elevation view as defined in FIG. 1.

FIG. 8 is a plan view of an alternate embodiment.

FIG. 9 is a side elevation view of the alternate embodiment.

FIG. 10 is a front elevation of the alternate embodiment.

DESCRIPTION OF THE PREFERRED EMBODIMENT

Figure 1:
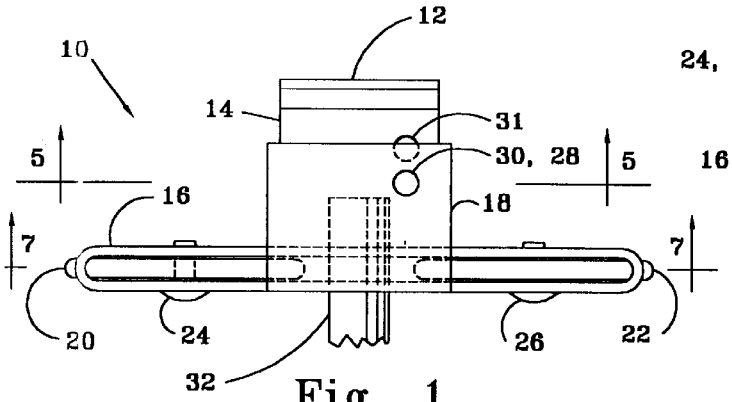
FIG. 1 is a plan view of the invention in the latched and locked position.
Figure 2:
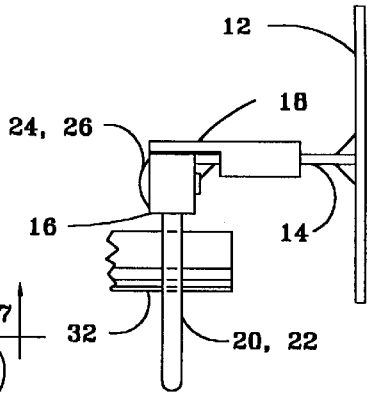
FIG. 2 is an end elevation view of the invention in the latched and locked position.

Referring to FIGS. 1 and 2, the invention is shown generally at 10. The bracket plate 12 is provided for attachment to a gate post by bolts, screws, or other suitable means. The body plate 14 is welded to the bracket plate 12. The frame ring 16 is welded to the body plate 14 to complete the fixed assembly. Rings 20 and 22 are suspended within the frame ring 16 with movement constrained to a range of positions limited by rivets 24 and 26, respectively. Lock plate 18 is shown in the locked position, extending over rings 20 and 22. A hole 30 in the lock plate 18 aligns with a hole 28 in the body plate so a pad lock (not shown) or a pin (not shown) may be inserted to lock the gate. A hole 30 in the lock plate 18 aligns with a hole 31 in the body plate so a pad lock (not shown) or a pin (not shown) may be inserted to secure the latch in the unlocked position.

Figure 3:
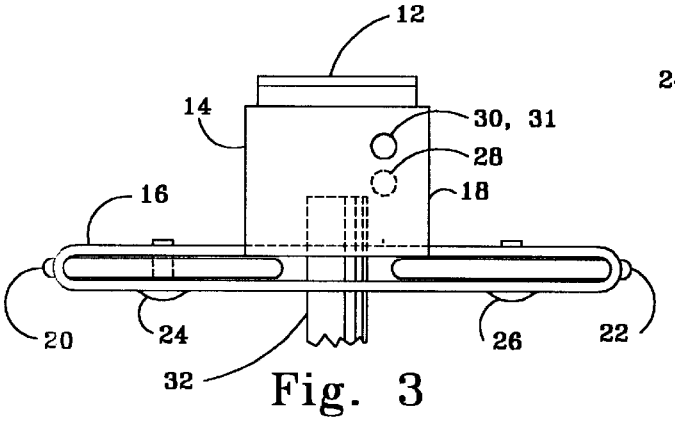
FIG. 3 is a plan view of the invention in the latched and unlocked position.
Figure 4:
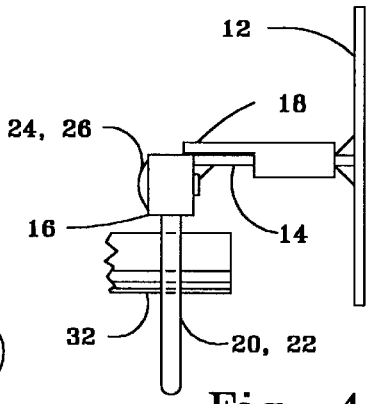
FIG. 4 is an end elevation view of the invention in the latched and unlocked position.

Referring to FIGS. 3 and 4, the invention is shown in the unlocked position, with the lock plate 1 8 moved toward the bracket plate 12. In this position, lock plate 18 clears the opening in the frame ring 16 to allow upward movement of rings 20 and 22. Hole 30 in frame plate 18 then aligns with hole 28 in the body plate 14 to allow the lock or pin to be stored, and also allows the lock plate 18 to be padlocked in the unlocked position to prevent accidental locking of the latch and to prevent loss of the padlock.

Figure 5:
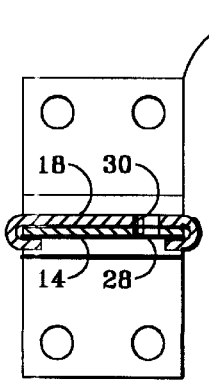
FIG. 5 is a cross section elevation as defined in FIG. 1.

FIG. 5 shows lock plate 18 formed to a U shape on each side to embrace body plate 14 in a sliding relationship. Hole 28 in body plate 14 and hole 30 in lock plate 18 align with the lock plate moved to a position away from the bracket plate 12 so that the end of the lock plate 1 8 is positioned above the rings 20 and 22 to prevent upward movement of rings 20 and 22 as illustrated in FIGS. 1 and 2.

Figure 6:
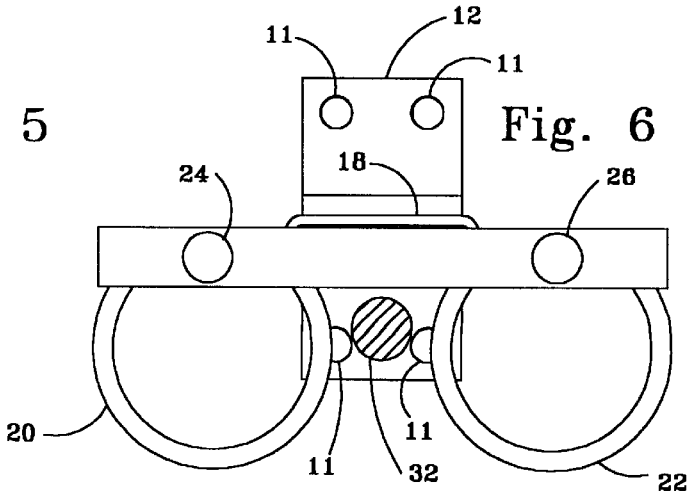
FIG. 6 is a front elevation view of the invention.

FIG. 6 shows the latch in the closed position where latch bar 32 is attached to the gate and swings with the gate on the gate hinges. Holes 11 may be used for bolts or screws to mount the fixed portion of the latch to a fence or gate post.

Referring to FIG. 7, latch bar 32 is shown in an intermediate position during closure of the gate moving in the direction shown by arrow 34, as ring 22 is rotated about rivet 26 to move upwardly, allowing latch bar 32 to move to a latched position between rings 20 and 22. Ring 20 or 22 may be pushed upwardly by hand to allow latch bar 32 to move past the ring to open the gate in the direction desired.

DESCRIPTION OF AN ALTERNATE EMBODIMENT

FIGS. 8, 9 and 10 show an alternate embodiment of the invention for use with a gate that opens in one direction only. Frame plate 112 may be mounted to a fence or gate post, using bolts or screws through holes 111. Frame 116 is formed in a U shape to guide ring 120. Ring 120 is constrained by rivet 126 through ring 120, the two sides of frame 116 and the end of frame 116 connecting the sides of frame 116. Holes 130 through the two sides of frame 116 provide for a padlock or pin to lock the gate.

OPERATION OF THE PREFERRED EMBODIMENT

The preferred embodiment provides a gate latch that will latch automatically when closed, and is easily unlatched to open the gate when desired. This gate latch also provides a latch that is easily locked closed with a padlock.

Referring to FIGS. 1 through 4, the fixed portion of the latch is mounted with suitable bolts, screws, or welding plate 12 to a gate post, not shown. The latch bar 32 is similarly attached to the gate, not shown. In operation, when the gate closes, the latch bar 32 moves in a horizontal arc about the gate hinges, not shown, and engages a ring, for example ring 22. As the latch bar 32 moves in a horizontal path engaging the ring 22, the ring is rotated about rivet 26 moving upwardly to allow the latch bar 32 to move past the ring 22. The ring 22 will fall by gravity to the position shown in FIGS. 1 through 6, thereby latching the gate.

Referring to FIG. 3, the rings 20 and 22, trap the latch bar 32 in the position shown. The rings 20 and 22 prevent lateral movement of the latch bar 32. For example, if the latch bar 32 moves toward ring 22, the ring would pivot about rivet 26 and engage the inside end of frame ring 16 which prevents further movement of ring 22 and thereby holds the latch bar 32 between the rings 22 and 24, holding the gate latched. The gate and latch bar 32 are prevented from opening in the other direction in the same manner.

In order to open the gate, for example, ring 22 must be raised manually far enough to allow the latch bar 32 to pass under ring 22 without the ring 22 engaging the inside end of frame ring 16. The same procedure is used to open the gate in the other direction by raising ring 20 to allow the latch bar to pass under ring 20.

Referring to FIGS. 1 and 2, lock plate 18 is shown in the locked position, extending above rings 20 and 22. In this position, rings 20 and 22 are prevented from rising a sufficient distance to allow the latch bar 32 to pass under rings 20 and 22. A padlock would deter unauthorized entry. The bolt or pin placed through the holes 28 and 30 would prevent possible opening by wind or other vibrations. The lock plate 18 can be fixed in this position, by placing a padlock, not shown, or a bolt, not shown through holes 28 and 30. Referring to FIG. 5, this cross section shows hole 30 in lock plate 18 aligned with hole 28 in frame plate 14.

Referring to FIGS. 3 and 4, lock plate 18 is shown in the unlocked position, away from rings 20 and 22. In this position, rings 20 and 22 are allowed to rise freely a sufficient distance to allow the latch bar 32 to pass under rings 20 and 22.

Referring to FIG. 6, lock plate 18 is shown moved toward bracket plate 12 to the unlocked position with holes 28 and 30 out of alignment. In this position, the gate may be latched simply by closing the gate as hereinafter described. The gate may be unlatched easily as hereinbefore described.

Referring to FIG. 7, latching of the gate is achieved by moving of the gate to the closed position. For example, if latch bar 32 is to the right of ring 22 in FIG. 7, as the gate is closed, the latch bar moves to the left in this figure, as shown by arrow 34 and engages ring 22. As the latch bar 32 engages ring 22, ring 22 moves to the left, then upwardly to allow passage of latch bar under and past ring 22.

The preferred embodiment has two rings, allowing a gate to be opened either inwardly or outwardly. Latching is automatic when the gate is closed from either direction. Upon closure of the gate, the latch bar 32 will swing the first engaged ring about the rivet suspending the ring. When the latch bar engages the second ring, the latch bar is stopped since the end of the frame ring 16 prevents the ring from pushing away from the latch bar or rotating about the rivet upon which the second ring is suspended. Once the latch bar passes under a ring, gravity will cause the ring to drop down next to the latch bar, latching the bar and the gate in closed position.

DESCRIPTION OF AN ALTERNATE EMBODIMENT

FIGS. 8, 9 and 10 illustrate an alternate embodiment which allows the gate to open in only one direction, the invention is shown generally at 110. The bracket plate 112 is intended to be attached to a gate post by bolts, screws, or other suitable means through holes 111. The frame 116 is welded to the bracket plate 112 to complete the fixed assembly. Ring 120 is suspended within the frame ring 116 with movement constrained to a range of positions limited by rivet 126, and the end of the frame 116. Stop plate 134 is welded to body plate 114 and frame ring 116.

OPERATION OF THE ALTERNATE EMBODIMENT

The operation of this alternate embodiment is the same as the preferred embodiment, except that the gate is allowed to swing in only one direction from the latch, and the one ring latches the gate upon closure. Frame 116 guides the movement of ring 120, allowing free movement between the sides, keeping the ring generally in one plane. The end of frame 116 prevents counterclockwise movement of ring 120 about rivet 126 as seen in FIG. 9, while allowing free movement of ring clockwise about rivet 126. When latch bar 132 is in position as shown in FIG. 9, it is prevented from movement to the right to open the gate so long as gravity holds the ring in the downward position shown. The gate may be opened easily by pushing the ring upwardly to allow the latch bar 132 to pass under the ring to an open position. The latch will automatically latch when the gate is closed when the latch bar 132 pushes ring 120 upwardly, clockwise about rivet 126, allowing the latch bar 132 to move into the closed position, whereupon gravity will lower ring 120 to the latched position shown.

I have disclosed a gate latch for use in securing a hinged gate or the like in a closed position, including a support adapted to be mounted on a fixed surface in close proximity to the gate, a plate extending laterally from the support and having two generally parallel sides, a frame member depending from the plate and having generally parallel sides a pair of pin means extending between the parallel sides, a pair of rings positioned between the parallel sides, each ring near one of the ends, and encircling the pin means to allow each ring to rotate away from the near end and to prevent the ring from rotating toward the end, a latch bar mountable on the gate to engage the rings to allow the latch bar to move from an open gate unlatched position away from the rings to engage one of the rings to rotate the ring about one of the pins to allow the latch bar to pass under the ring to engage other of the rings, allowing the one of the rings to drop into latching position, whereby the latch bar is latched between the rings to close and latch the gate, a lock member moveable on the plate along the parallel sides from a first position extending above the rings to prevent upward movement of the rings to a second position clear of the rings to allow upward movement of the rings to allow the latch to pass under either of the rings, and the rings each individually manually displacable upwardly while the lock member is in the second position, to allow the latch bar to move from a latched closed gate position between the rings past the displaced ring to an unlatched position to open the gate.

I have also disclosed a gate latch which includes frame means for mounting on a fixed surface and connected to a pair of parallel generally rectangular sides, the sides joined at the end of the parallel sides away from the frame means, a pin extending between the parallel sides, a ring positioned between the parallel sides, the ring near the end, and surrounding the pin to allow the ring to rotate away from the end and to prevent the ring from rotating toward the end, a latch bar mountable on the gate to engage the ring to allow the latch bar to move from an unlatched open gate position to engage the ring and rotate the ring about the pin to allow the latch bar to pass under the ring to a closed gate position to engage the frame means, allowing the ring to drop into latching position, and holes through both the parallel sides aligned to allow insertion of a padlock to prevent upward movement of the ring to prevent the latch bar from passing under the ring.

I have also disclosed a gate latch including frame means for mounting the latch to a fixed object, latch bar means for mounting on a gate, ring lock means for latching to the latch bar means included in the frame means, movable lock member means, included in the frame means, for restricting movement of the ring lock means to lock the gate latch while the latch bar means is latched, and means for receiving a padlock for locking the movable lock member means.

I have also disclosed a latch for securing a hinged gate or the like, in a closed position, including a support adapted for mounting to a fixed surface in close proximity to the hinge supported item to be latched, an elongated plate extending laterally from the support, a support frame depending from the plate at a location displaced from the support, a latch bar on the hinged item for pivotal displacement therewith, an arcuately displaceable ring depending from within the frame in the displaced path of the latch bar, securement means of the frame permitting displacement of the ring to pass and receive the latch bar when engaged by the latch bar moving in a first latching direction and restricting displacement of the ring when engaged by the latch bar moving in an unlatching direction; securement means on the frame permitting displacement of the other of the rings to pass and receive the latch bar when engaged by the latch bar moving in a direction opposite first latching direction and restricting displacement of the ring when engaged by the latch bar moving in an unlatching direction; and means for locking the ring in the depending position. I have disclosed this latch further including the locking means having means for receiving a padlock to lock the ring in closed relation of the securement means. This latch also has the ring surrounding and is supported by a pin in the support frame in the depending relation to the frame. This latch provides for the ring to be self descending after engagement with the latch bar, by gravity.

I have disclosed a latch for securing a hinged item, a gate or the like, in a closed position, including a support adapted for mounting to a fixed surface in close proximity to the hinge supported item to be latched, an elongated plate extending laterally from the support, a support frame depending from the plate at a location displaced from the support, a latch bar on the hinged item for pivotal displacement therewith, a pair of arcuately displaceable rings depending from within the frame in the displaced path of the latch bar, securement means on the frame rings to pass and receive the latch bar when engaged by the latch bar moving in a latching direction and restricting displacement of the ring when engaged by the latch bar moving in an unlatching direction; and means for locking the rings to prevent displacement of the rings from a latching position. This latch further includes the locking means having means for receiving a padlock to lock the rings in closed relation of the securement means. This latch is further defined in that each ring surrounds a pin in the support frame to support the rings in the depending relation to the frame. This latch is self descending after engagement with the latch bar.

I claim:

1. A gate latch adapted to secure a hinged item in a closed position, comprising:

a support adapted to be mounted on a fixed surface in close proximity to a hinged item, a plate extending horizontally from said support and having two generally parallel sides, a frame member depending from said plate and having generally parallel sides, said parallel sides each having two ends, said parallel sides of said frame member joined to each other at both of said ends, a pair of pin means extending between said parallel sides of said frame member, a pair of rings positioned between said parallel sides of said frame, each ring near one of said ends of said parallel sides of said frame member, and encircling said pin means to allow each ring to rotate away from said end nearer said ring and to prevent each ring from rotating toward said end, nearer said ring, a latch bar mountable on a hinged item to engage said rings to allow said latch bar to move from an open hinged item unlatched position away from said rings to engage one of said rings to rotate said ring about one of said pins to allow said latch bar to pass under said ring to engage other of said rings, allowing said one of said rings to drop into latching position, whereby said latch bar is latched between said rings to close and latch said hinged item, a lock member mounted so as to be moveable on said plate along it's parallel sides from a first position engagable with said rings to prevent movement of said rings to a second position clear of said rings to allow movement of said rings to allow said latch to pass either of said rings, and said rings each individually manually displacable while said lock member is in said second position, to allow said latch bar to move from a latched closed hinged item position between said rings past the displaced ring to an unlatched position to open a hinged item.

2. A latch adapted to secure a hinged gate in a closed position, comprising:

a support adapted for mounting to a fixed surface in close proximity to said hinge supported item to be latched, an elongated plate extending laterally from said support, a support frame depending from said plate at a location displaced from said support, a latch bar adapted for mounting on said hinged item for pivotal displacement therewith, a pair of arcuately displaceable rings, a first ring and a second ring, depending from within said frame and spaced apart along and in the displaced path of said latch bar, said frame having securement means permitting displacement of said first ring to pass and receive said latch bar when engaged by said latch bar moving in a first latching direction into a latched position and restricting displacement of said first ring when engaged by said latch bar moving in an unlatching direction;

said securement means on said frame permitting displacement of said second rings to pass and receive said latch bar when engaged by said latch bar moving in a direction opposite first latching direction into a latched position and restricting displacement of said second ring when engaged by said latch bar moving in an unlatching direction; and a lock plate engaged with said elongated plate and mounted to be linearly slidable on said elongated plate to a first position engagable with said rings to prevent displacement of said rings from engagement with said latch bar, said lock plate slidable to a second position on said elongated plate to allow displacement of said rings from engagement with said latch bar.

3. A latch according to claim 2 further comprising:

a hole in said elongated plate, a hole in said lock plate, said hole in said elongated plate and said hole in said lock plate aligned and adapted in said first position to allow use of a padlock in said holes whereby said lock plate is locked in said first position.

4. A latch according to claim 2 wherein each said ring surrounds and depends from a pin in said support frame in said depending relation to said frame.

5. A latch according to claim 2 wherein each said ring is self descending after engagement with said latch bar.

6. A latch adapted to secure a hinged item in a closed position, comprising:

a support adapted for mounting to a fixed surface in close proximity to the hinged item to be latched, an elongated plate extending laterally from said support, a support frame depending from said plate at a location displaced from said support, a latch bar adapted to be mounted on said hinged item for pivotal displacement therewith, a pair of arcuately displaceable rings depending from within said frame in the displaced path of said latch bar, said frame having securement means permitting displacement of each of said rings to pass and receive said latch bar when engaged by said latch bar moving in a latching direction and restricting displacement of each of said rings when engaged by said latch bar moving in an unlatching direction; and a lock plate engaged with said elongated plate and slidable on said elongated plate to a first position engagable with said rings to prevent displacement of said rings from engagement with said latch bar, said lock plate mounted to be linearly slidable to a second position on said elongated plate to allow displacement of said rings from engagement with said latch bar.

7. A latch according to claim 6 further comprising:

a hole in said elongated plate, a hole in said lock plate, said hole in said elongated plate and said hole in said lock plate aligned and adapted in said first position to allow use of a padlock in said holes whereby said lock plate is locked in said first position.

8. A latch according to claim 6 wherein each said ring surrounds a pin in said support frame to support said rings in said depending relation to said frame.

9. A latch according to claim 6 wherein each said ring is self descending after engagement with said latch bar.

* * * * *